US007331333B2

(12) United States Patent
Maitani

(10) Patent No.: US 7,331,333 B2
(45) Date of Patent: Feb. 19, 2008

(54) DIRECT FUEL INJECTION/SPARK IGNITION ENGINE CONTROL DEVICE

(75) Inventor: Takao Maitani, Isehara (JP)

(73) Assignee: Nissan Motor Co., Ltd., Yokohama (JP)

( * ) Notice: Subject to any disclaimer, the term of this patent is extended or adjusted under 35 U.S.C. 154(b) by 572 days.

(21) Appl. No.: 11/032,206

(22) Filed: Jan. 11, 2005

(65) Prior Publication Data

US 2005/0155568 A1 Jul. 21, 2005

(30) Foreign Application Priority Data

Jan. 19, 2004 (JP) ..... 2004-009922

(51) Int. Cl.
*F02M 37/04* (2006.01)

(52) U.S. Cl. ..... 123/500; 123/179.17

(58) Field of Classification Search ..... 123/500, 123/501, 357, 179.17, 295, 305, 294
See application file for complete search history.

(56) References Cited

U.S. PATENT DOCUMENTS 5,078,107 A * 1/1992 Morikawa ..... 123/295
6,062,189 A * 5/2000 Kaneko et al. ..... 123/295
6,371,086 B1 * 4/2002 Matsubara et al. ..... 123/500
6,513,488 B2 * 2/2003 Enoki et al. ..... 123/305
2003/0074890 A1 * 4/2003 Yamashita et al. ..... 60/284
2004/0163378 A1 * 8/2004 Sasaki et al. ..... 60/284
2006/0118079 A1 * 6/2006 Shiraishi et al. ..... 123/295

FOREIGN PATENT DOCUMENTS

EP 1350936 A 10/2003
JP H09-079066 A 3/1997
JP 2001-041081 A 2/2001
JP 2001-090578 A 4/2001
JP 2001-280185 A 10/2001
JP 2001-342873 A 12/2001
JP 2002-180943 A 6/2002
WO WO-02/075137 A1 9/2002

* cited by examiner

*Primary Examiner*—Carl S. Miller
(74) *Attorney, Agent, or Firm*—Global IP Counselors, LLP

(57) ABSTRACT

A direct fuel injection/spark ignition engine control device is configured to enable compression stroke injection when the fuel pressure is low at startup and immediately after startup, and to reduce the wall flow and amount of HC exhaust. When the catalyst requires warming, fuel is injected in the compression stroke, and the fuel injection timing in the compression stroke is set in accordance with the fuel pressure. When the fuel pressure is low, the fuel injection timing injects fuel in the first half of the compression stroke. The fuel injection timing is delayed as the fuel pressure increases until the optimum fuel injection timing is reached.

20 Claims, 7 Drawing Sheets

DIRECT FUEL INJECTION/SPARK IGNITION ENGINE CONTROL DEVICE

CROSS-REFERENCE TO RELATED APPLICATIONS

This application claims priority to Japanese Patent Application No. 2004-009922. The entire disclosure of Japanese Patent Application No. 2004-009922 is hereby incorporated herein by reference.

BACKGROUND OF THE INVENTION

1. Field of the Invention

The present invention generally relates to a control apparatus for a direct-injection spark-ignition internal combustion engine. More specifically, the present invention relates to a control apparatus that allows suitable combustion control even at startup, immediately after startup, and at other times in which fuel pressure is low.

2. Background Information

Japanese Laid-Open Patent Application No. 2001-342873 discloses is a technique in which intake stroke injection is selected that primarily injects fuel in the intake stroke when the fuel pressure is low in a direct-injection spark-ignition internal combustion engine, and continuous fuel injection is limited to a permissible interval of the initial phase of the compression stroke when it is impossible to inject fuel in the set injection amount within the intake stroke.

In view of the above, it will be apparent to those skilled in the art from this disclosure that there exists a need for an improved direct-injection engine control apparatus. This invention addresses this need in the art as well as other needs, which will become apparent to those skilled in the art from this disclosure.

SUMMARY OF THE INVENTION

It has been discovered that when intake stroke injection is carried out at startup, immediately after startup, and at other times when the engine is cold, a substantial portion of the fuel adheres with the cylinder wall, the piston crown surface, the intake valves, and other components. This adherence of the fuel results in wall flow of the fuel, which in turn increases the amount of HC in the exhaust gases at the engine exhaust port of the combustion chamber. Also when the engine is cold, the catalyst for exhaust cleaning provided in the exhaust passage has not yet been activated. This results in an increase in the amount of HC being exhausted without reduction.

The present invention was contrived in view of the foregoing. One object of the present invention is to provide a way to enable compression stroke injection even at startup, immediately after startup, and at other times when the fuel pressure is low, and to reduce the amount of HC exhaust during combustion.

In order to achieve the above identified object and other objects of the present invention, a direct fuel injection/spark ignition engine control device is provided that basically comprises a fuel pressure detection section and a fuel injection control section. The fuel pressure detection section is configured to detect fuel pressure supplied by a fuel pump to a fuel injection valve. The fuel injection control section is configured to set fuel injection timing to inject fuel in a compression stroke in accordance with the fuel pressure and in accordance with a catalyst warming condition. The fuel injection control section is further configured to set fuel injection timing to inject fuel in the compression stroke when the fuel pressure is low, and delay the fuel injection timing as the fuel pressure increases.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
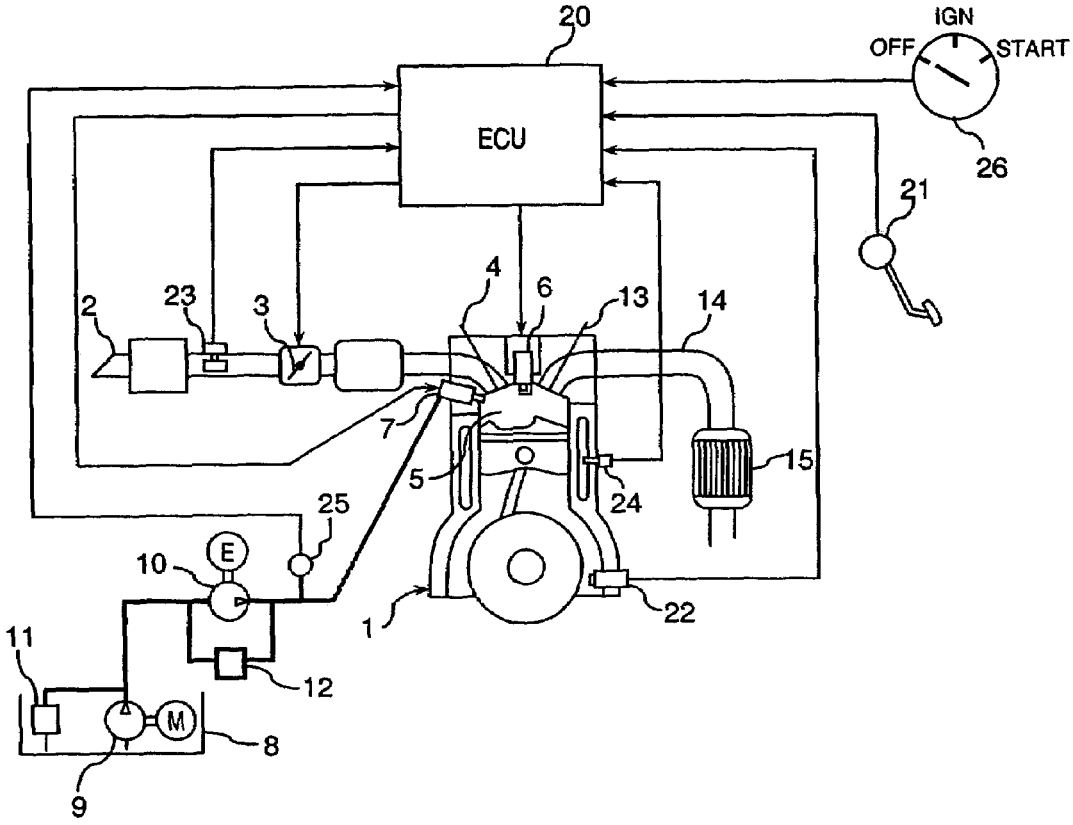
FIG. 1 is a diagrammatic view of an engine system illustrating a direct fuel injection/spark ignition engine control device for an internal combustion engine in accordance with a first embodiment of the present invention.

Referring initially to FIG. 1, an engine 1 is diagrammatically illustrated that is equipped with a direct fuel injection/spark ignition engine control device in accordance with a first embodiment of the present invention. The engine 1 has an air intake passage 2 with an electronically controlled throttle valve 3 mounted therein. The electronically controlled throttle valve 3 is configured and arranged for controlling the intake air quantity to the air intake passage 2 of the engine 1 by way of one or more intake valves 4 (only one shown). The air intake passage 2 is fluidly connected to a plurality of combustion chambers 5 (only one shown) of the engine 1. Each combustion chamber 5 includes a spark plug 6 and a fuel injection valve 7. The spark plug 6 and the fuel injection valve 7 are mounted to the combustion chamber 5 in a conventional manner.

The position of the electrically controlled throttle valve 3 is controlled by a stepping motor or other device operated by a signal from an engine control unit 20 (ECU). The air controlled by the electrically controlled throttle valve 3 is taken into the combustion chamber 5 of the engine 1 by way of the intake valves 4.

Following is a description of the system for supplying fuel to the fuel injection valve 7. Fuel in the fuel tank 8 is taken in by a low-pressure fuel pump 9 driven by an electric motor M. The low pressure fuel is then discharged from the low-pressure fuel pump 9 and fed to the high-pressure fuel pump 10 driven by the engine 1. The pressure of the fuel discharged from the low-pressure fuel pump 9 and fed to the high-pressure fuel pump 10 is adjusted to maintain a predetermined low pressure by a low-pressure pressure regulator 11 that is interposed in the return channel that goes back to the fuel tank 8. The high-pressure fuel discharged from the high-pressure fuel pump 10 is adjusted to a predetermined high pressure by a regulator 12 interposed in the return channel that goes back to the intake side of the high-pressure fuel pump 10.

The fuel injection valve 7 is designed to open when the solenoid is energized by an injection pulse signal output from the engine control unit 20 in the intake stroke or the compression stroke in synchronization with the engine, and to injection fuel adjusted to a predetermined pressure in the combustion chamber 5. It should be noted that since the low-pressure fuel pump 9 is driven by the drive motor after the ignition switch has been turned on, and the high-pressure fuel pump 10 is driven by the engine after the start switch has been turned on, the increase in fuel pressure supplied from the high-pressure fuel pump 10 to the fuel injection valve 7 occurs after the start switch has been turned on.

The fuel injected in the combustion chamber 5 forms an air-fuel mixture, and is ignited by the spark plug 6 and combusted. The engine 1 also has one or more exhaust valves 13 arranged in each of the combustion chambers 5 with the exhaust ports being fluidly connected to an exhaust passage 14. The exhaust passage 14 includes a catalytic converter 15 with a catalyst for exhaust purification in a conventional manner. Thus, the air-fuel mixture after being combusted results in exhaust being expelled to the exhaust passage 14 by way of the exhaust valve(s) 13. The exhaust is then fed to the catalytic converter 15 for cleaning the exhaust.

The engine 1 is controlled by an engine control unit or engine control unit 20 to perform the controlled combustion of the fuel air mixture as discussed below. The engine control unit 20 is a microcomputer comprising of a central processing unit (CPU) and other peripheral devices. The engine control unit 20 can also include other conventional components such as an input interface circuit, an output interface circuit, and storage devices such as a ROM (Read Only Memory) device and a RAM (Random Access Memory) device. The engine control unit 20 preferably includes an engine control program that controls various components as discussed below. The engine control unit 20 receives input signals from various sensors (described below) that serve to detect the operating state of the engine 1 and executes the engine controls based on these signals. It will be apparent to those skilled in the art from this disclosure that the precise structure and algorithms for the engine control unit 20 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

Examples of signals input to the engine control unit 20 include the accelerator position Apo detected by the accelerator pedal sensor 21, the engine speed Ne detected by the crank angle sensor 22, the air intake quantity Qa detected by the air flow meter 23, the engine coolant temperature (water temperature) detected by the water temperature sensor 24, and the fuel pressure Pf from the high-pressure fuel pump 10 to the fuel injection valve 7 that is detected by the fuel pressure sensor 25 as a fuel pressure detection section or device. Signals are also input from the engine key switch 26 having an ignition switch and a start switch.

The engine control unit 20 controls the position of the electrically controlled throttle valve 3, the timing and amount of fuel injection of the fuel injection valve 7, the timing of the spark plug 6, and other parameters on the basis of the engine operating conditions detected by the input signals.

The combustion operating modes of the engine basically includes a stratified operating mode and a homogenous operating mode. In other words, the engine control unit 20 is configured to perform a selected combustion mode (homogenous combustion, stratified combustion) based on the engine operating conditions detected by these input signals, and control the opening of the electronically controlled throttle valve 3, the fuel injection timing and fuel injection quantity of the fuel injection valve 7, and the ignition timing of the spark plug 6 accordingly.

In the stratified operating mode, fuel is injected in the second half of the compression stroke, and stratified combustion is performed with a very lean air-fuel mixture (A/F=30 to 40) overall by forming an air-fuel mixture mass that is stratified in the area around the spark plug 6 in the combustion chamber 5. In other words, under normal operating conditions (after warming-up is completed), extremely lean stratified combustion is performed with an A/F ratio of about 30 to 40 (stratified lean combustion). In the homogenous operating mode, on the other hand, fuel is injected in the intake stroke, and homogenous combustion is performed with a stoichiometric or lean air-fuel mixture (A/F=20 to 30) by forming a homogenous air-fuel mixture throughout the combustion chamber 5.

It should be noted that control during startup and warming, the present invention is essentially carried out using the stratified operating mode with compression stroke injection, and the air-fuel mixture is richer than the stratified operating mode after warming in a range between slightly richer than a stoichiometric mixture and slightly leaner than a stoichiometric mixture.

In other words, in the present invention as explained below, fuel is injected in the compression stroke when the catalyst requires warming, the fuel injection timing in the compression stroke is set in accordance with the fuel pressure, the fuel injection timing is set to occur in the first half of the compression stroke when the fuel pressure is low, and the fuel injection timing is delayed as the fuel pressure increases. In other words, in the present invention, the fuel injection timing is carried out in the first half of the compression stroke when the internal cylinder pressure is low, and a minimal amount of compression stroke injection is allowed when the fuel pressure is low. Since fuel injection is made possible when the fuel pressure gradually increases and overcomes the internal cylinder pressure even if the fuel injection timing is delayed, the fuel injection timing is delayed as the fuel pressure increases and can be moved toward the optimum injection timing. Compression stroke injection is therefore made possible from when fuel pressure is low, the generation of wall flow is reduced to the extent possible, and a reduction in the amount of HC exhausted can be ensured.

Figure 2:
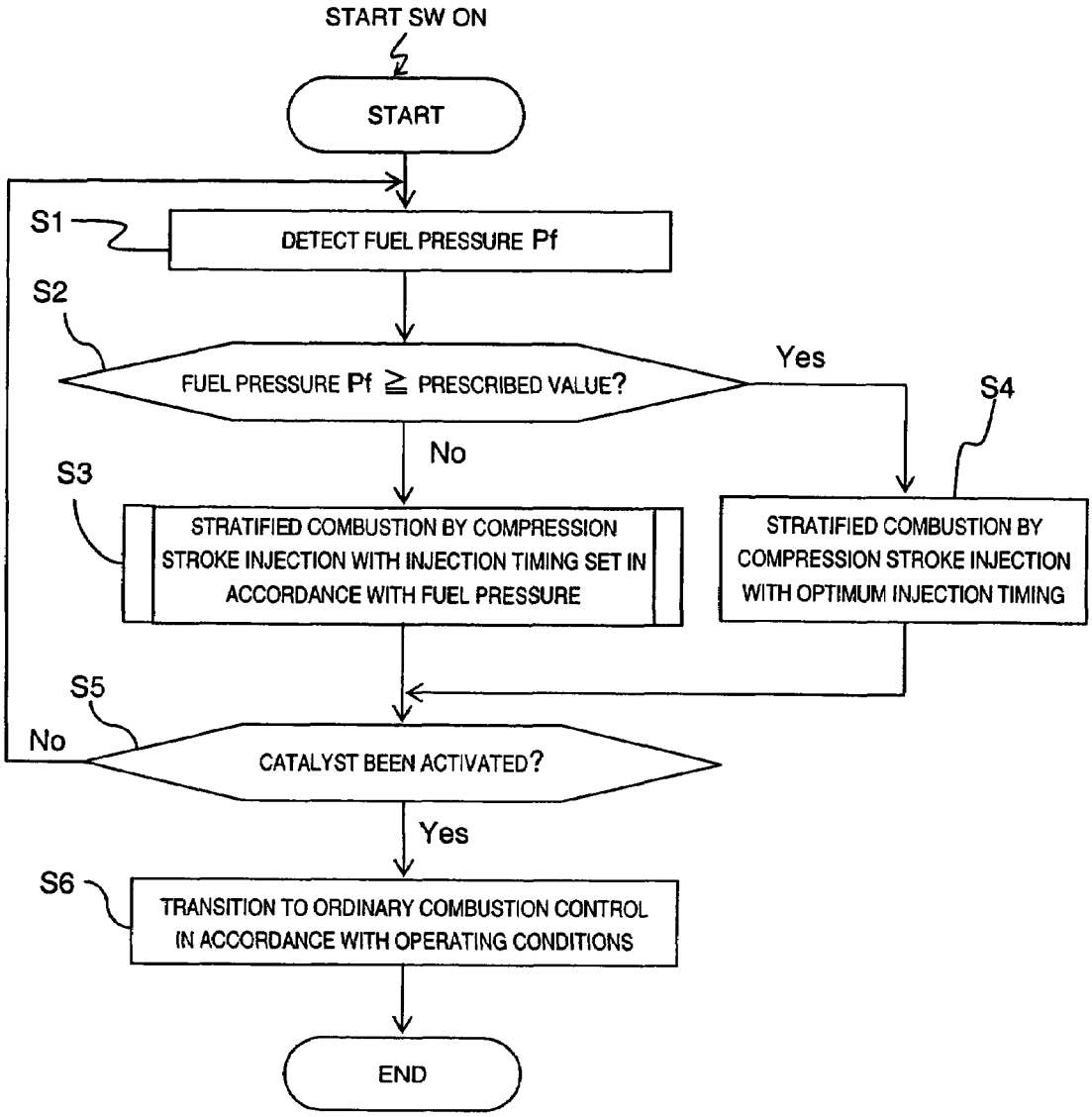
FIG. 2 is a flowchart showing the main control routine that is executed by the control unit from startup to during warm-up of the direct fuel injection/spark ignition engine control device in accordance with the first embodiment of the present invention.
Figure 3:
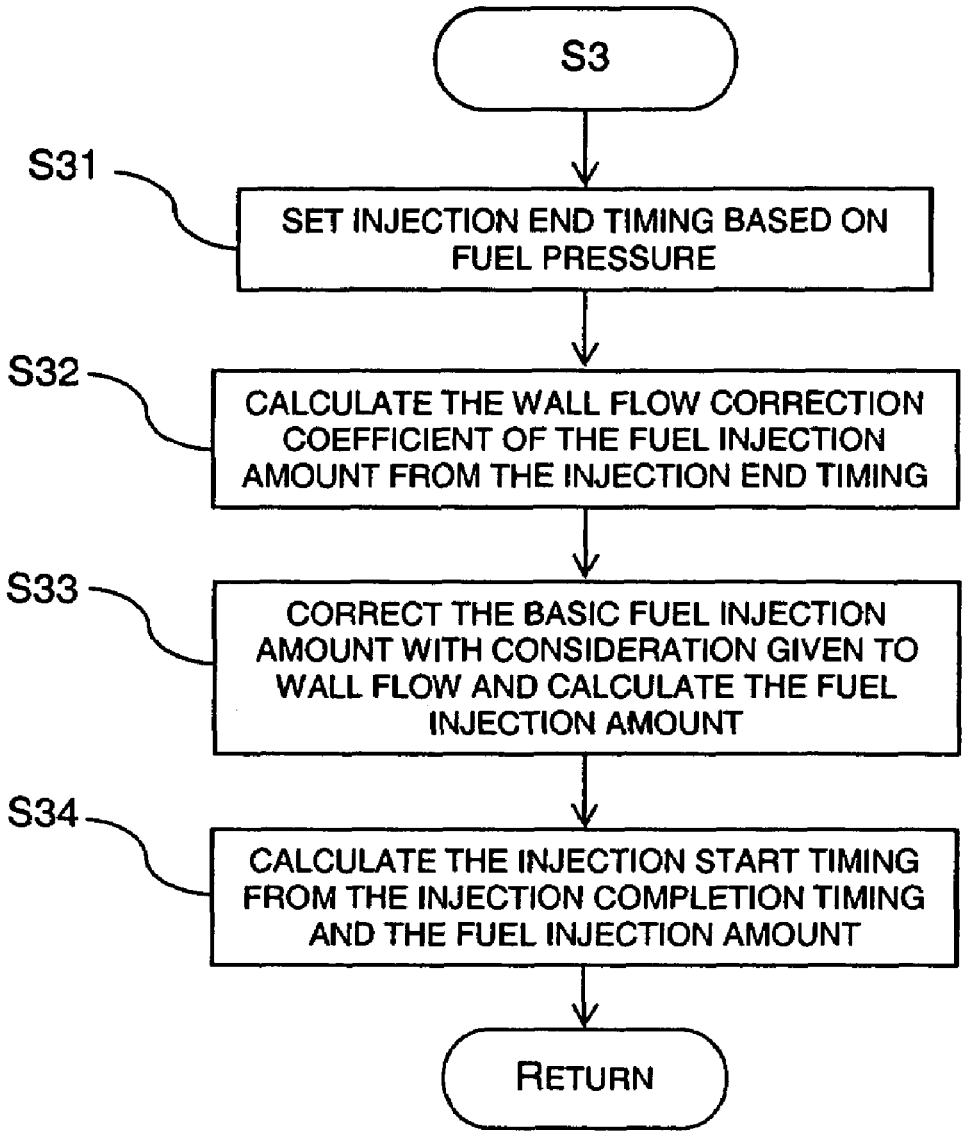
FIG. 3 a flowchart showing the subroutine that is executed by the control unit in step S3 of the main control routine of FIG. 3.

Next, referring to FIGS. 2 and 3, the combustion operating mode during startup and warming of the engine 1 will be described in accordance with the present invention. FIG. 2 is a flowchart of the main control routine during startup and warming of the engine 1 carried out by the engine control unit 20. FIG. 3 is a flowchart of the subroutine of step S3 in FIG. 2. The flowchart of FIG. 2 is started when the start switch is turned on after the ignition switch has been turned on.

In step S1, the fuel pressure Pf is detected by the fuel pressure sensor 25. In step S2, a determination is made whether the detected fuel pressure Pf has overcome the internal cylinder pressure with optimum injection timing in the compression stroke, and a prescribed value (threshold value SL) at which fuel can be injected has been exceeded. When the fuel pressure Pf is equal to or less than the prescribed threshold value SL, the system advances to step S3, and stratified combustion is carried out with compression stroke injection at an injection timing that is associated with the fuel pressure Pf. The details of this process of step S3 are shown in FIG. 3.

Figure 4:
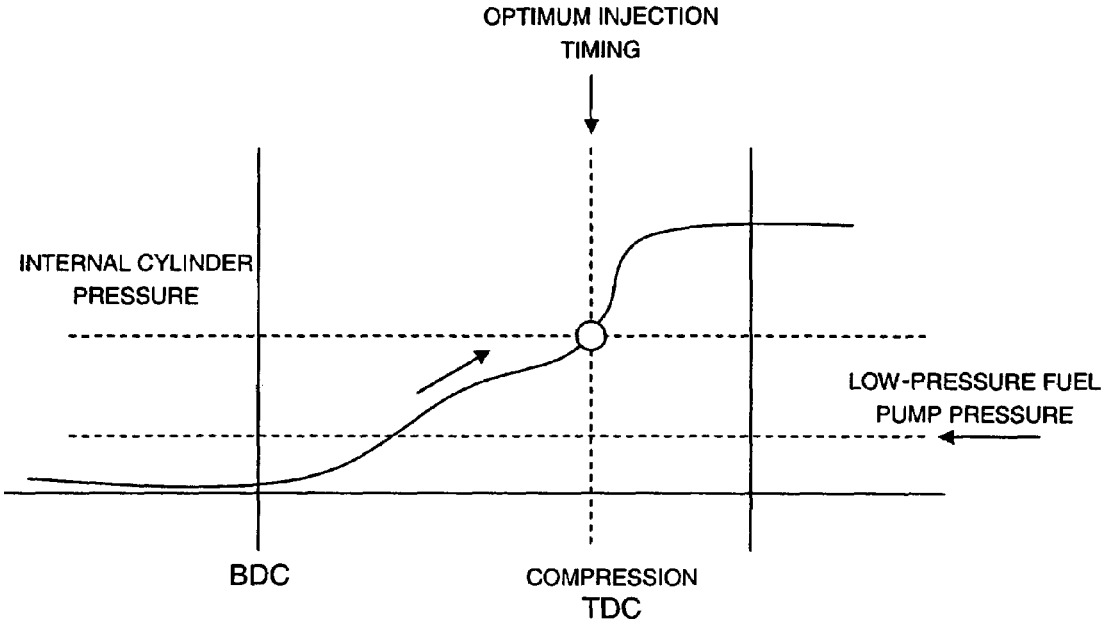
FIG. 4 is characteristics diagram of the internal cylinder pressure.
Figure 5:
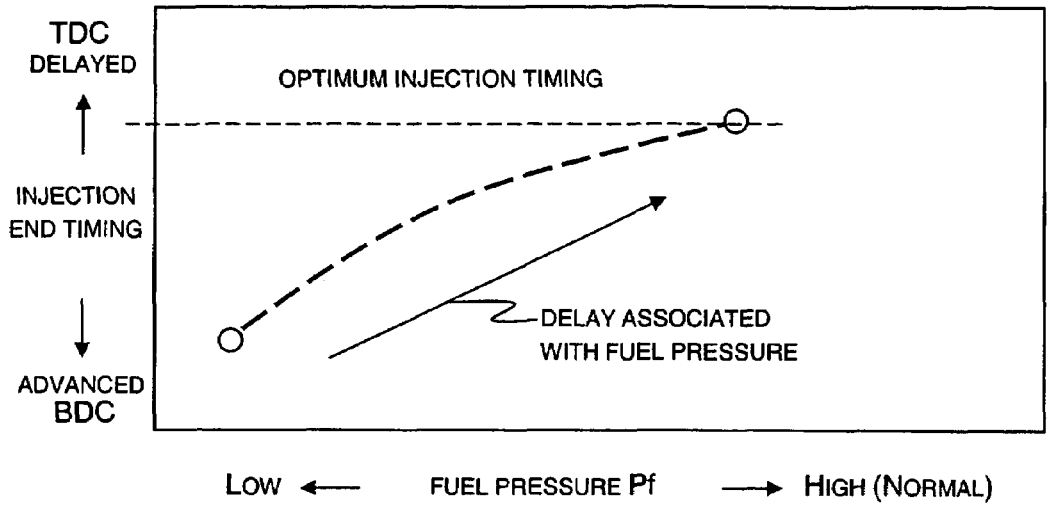
FIG. 5 is diagram showing the relationship between the fuel pressure and the injection end timing.

In step S31, the fuel injection timing in which the internal cylinder pressure is overcome and fuel can be injected is set as the fuel injection timing of the delay limit in accordance with the fuel pressure Pf. In particular, the injection end timing ITe is set as the fuel injection timing of the delay limit in accordance with the fuel pressure Pf. More specifically, since the internal combustion pressure increases as the piston approaches TDC in the compression stroke (BDC to TDC), as shown in FIG. 4, fuel can be injected only in the first half of the compression stroke when the fuel pressure is low (when substantially equal to the fuel pressure produced by the low-pressure fuel pump 9, for example). However, fuel can be injected at the target optimum fuel injection timing if the fuel pressure is sufficiently high, so the injection end timing is set as follows. In particular, the injection end timing ITe is set in accordance with the fuel pressure Pf with reference to the table in FIG. 5. The injection end timing ITe is set to the first half of the compression stroke when the fuel pressure Pf is low, and the injection end timing ITe is set so as to be delayed as the fuel pressure Pf increases. Since the internal cylinder pressure varies in accordance with the operation conditions of the engine (engine speed Ne in particular), the injection end timing ITe can be set with consideration for these conditions. Also, when an internal cylinder pressure sensor is provided, the actual internal cylinder pressure can be detected and compared with the fuel pressure to set the injection end timing ITe.

Figure 6:
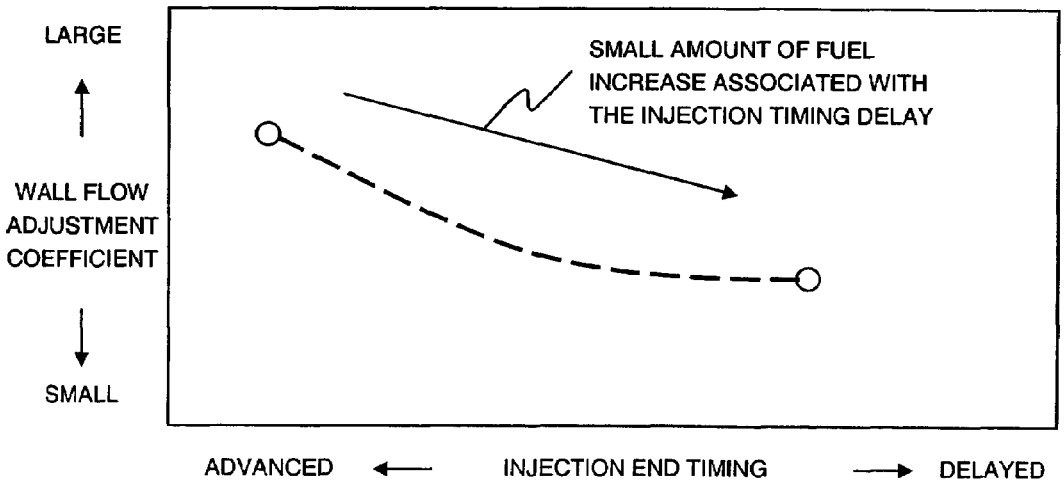
FIG. 6 is diagram showing the relationship between the injection end timing and the wall flow adjustment coefficient.

In step S32, the wall flow correction coefficient KWF of the fuel injection amount is set in accordance with the injection end timing ITe. Specifically, the wall flow correction coefficient KWF is set in accordance with the injection end timing ITe with reference to the table in FIG. 6. Thus, the wall flow correction coefficient KWF is set to a larger value as the injection end timing ITe is advanced. This is due to the fact that wall flow is markedly reduced in compression stroke injection in comparison with intake stroke injection. Since wall flow tends to increase as the injection timing is advanced even in compression stroke injection, the fuel injection amount must be adjusted upward by an equivalent amount in order to ensure the amount of fuel that contributes to combustion. In other words, the fuel injection amount is adjusted in accordance with the fuel injection timing, and the fuel injection amount is increased as the fuel injection timing is advanced.

Figure 7:
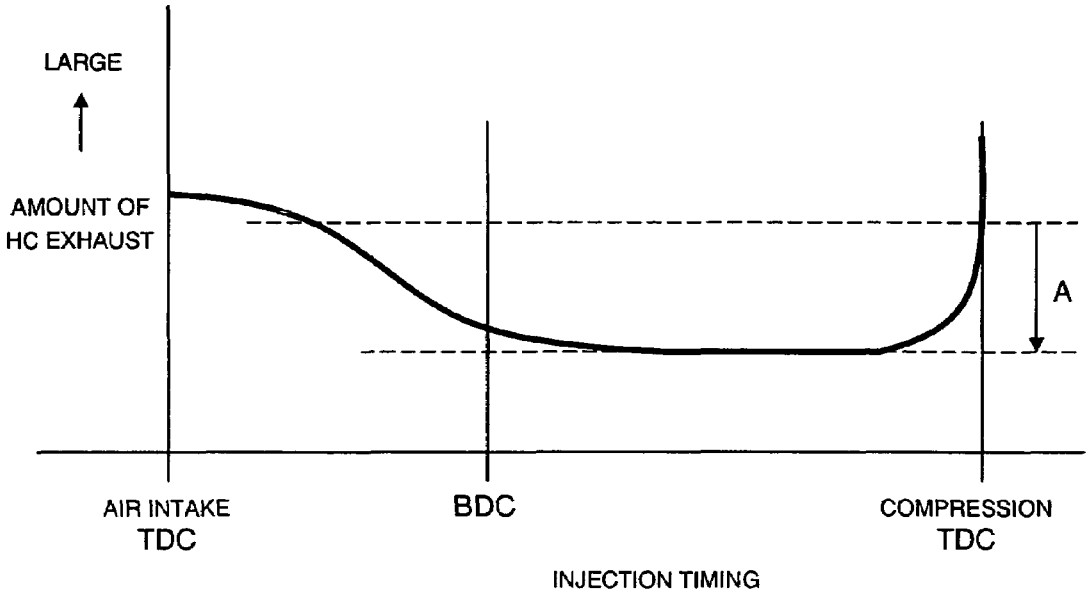
FIG. 7 is diagram showing the relationship between the injection timing and the amount of HC exhaust produced.

FIG. 7 shows the relationship between the injection timing and the amount of HC exhaust. It is apparent that the amount of HC exhaust is increased by the increase of wall flow as the injection timing is advanced even in compression stroke injection. It is also apparent that the amount of HC exhaust is decreased by the decrease of wall flow if the injection timing is delayed. The reason that the HC exhaust amount increases when the injection timing is considerably delayed is that the vaporization time is insufficient. In step S33, the basic fuel injection amount Tp=K×Qa/Ne (where K is a constant) calculated from the air intake quantity Qa and the engine speed Ne is modified with the wall flow correction coefficient KWF as noted in the following formula to calculate the fuel injection amount Ti.

$$Ti=Tp\times(1+KWF)$$

Adjustment coefficients other that the wall flow correction coefficient KWF are used in the calculation of the actual fuel injection amount Ti, but these are omitted here. In step S34, the injection start timing ITs is calculated from the injection end timing ITe and the fuel injection amount Ti. In other words, the crank angle needed to completely inject the fuel of the fuel injection amount Ti is calculated, and the position to which the crank angle has advanced from the injection end timing ITe is set as the injection start timing ITs.

When the injection start timing ITs is calculated in this fashion, the fuel injection amount Ti is injected with this timing.

After step S3 has been carried out, the system advances to step S5. In step S5, a determination is made whether the catalytic converter 15 has been activated. Specifically, when a catalyst temperature sensor is provided, the catalyst temperature is detected thereby. When a catalyst temperature sensor is not provided, the catalyst temperature is estimated from the coolant temperature Tw. The catalyst temperature can alternatively be estimated based on the coolant temperature at startup and the integrated value of the intake amount after startup. A determination is made whether the detected or estimated catalyst temperature is equal to or greater than the predetermined activation temperature.

When the catalytic converter 15 has not been activated, the system returns to step S1. When the fuel pressure Pf has exceeded a predetermined value in the determination carried out in step S2, then the fuel pressure overcomes the internal cylinder pressure with optimum injection timing in the compression stroke to make fuel injection possible, so the system advances to step S4. In other words, when the fuel pressure Pf has exceeded a predetermined value through an increase in the discharge amount produced by the high-pressure fuel pump 10 due to an increase in the engine speed after startup, then the fuel pressure overcomes the internal cylinder pressure with optimum injection timing in the compression stroke to make fuel injection possible, so the system advances to step S4.

In step S4, stratified combustion is carried out by compression stroke injection with optimum injection timing. The optimum injection timing is set in the range of the second half of the compression stroke and is preferably set based on the engine speed and load, as is apparent from the characteristics shown in FIG. 7. The system thereafter advances to step S5.

When the system has been determined in step S5 that the catalytic converter 15 has been activated, the system advances to step S6, and a transition is made to ordinary combustion control in accordance with operating conditions. In ordinary combustion control, normal stratified combustion or homogeneous combustion is selected in accordance with operating conditions (engine speed, load).

Figure 8:
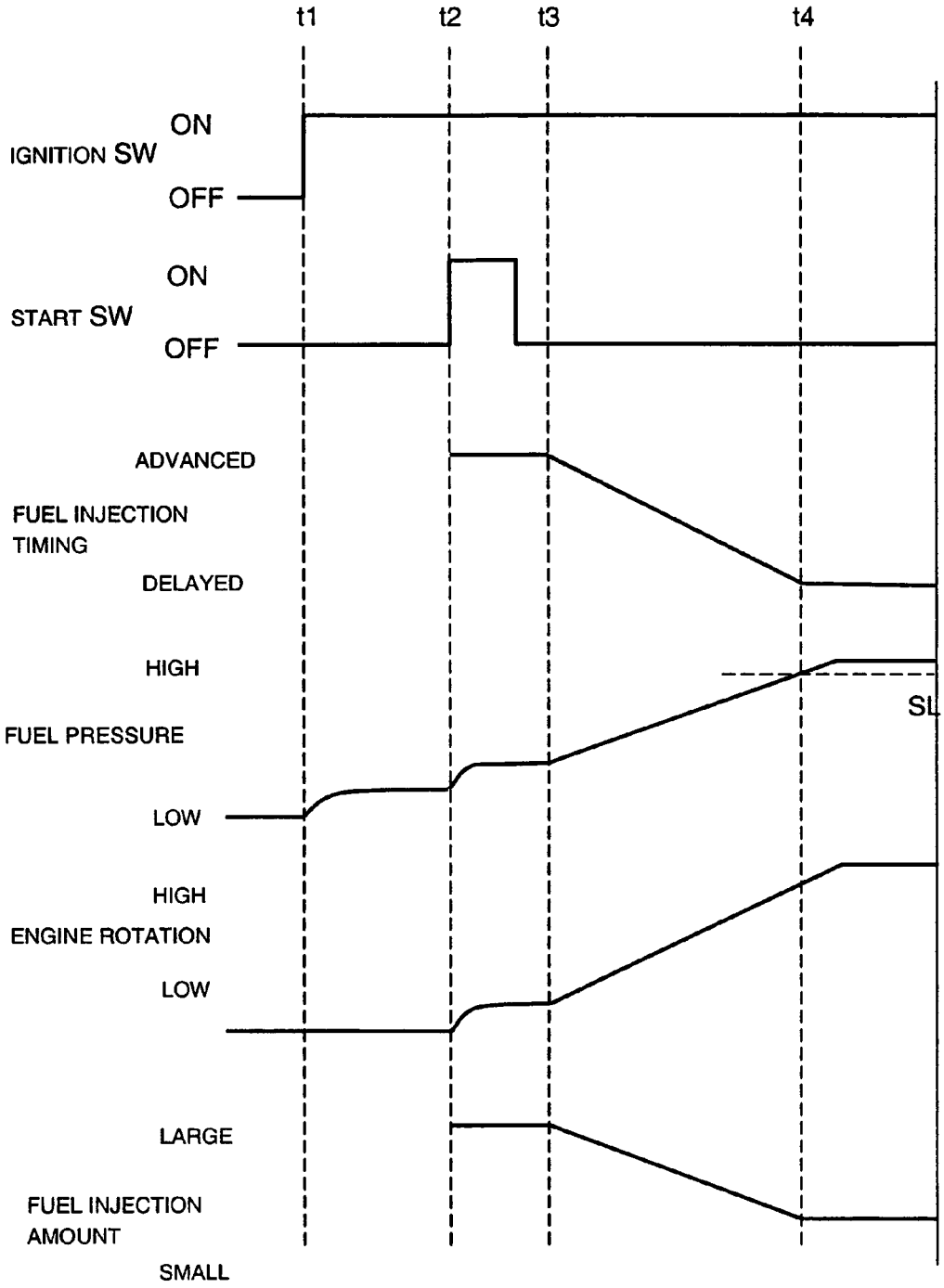
FIG. 8 is timing chart of control during startup and warming of the engine.

FIG. 8 is a timing chart of control during startup and warming of the engine 1.

The ignition switch is turned on at t1 and the low-pressure fuel pump 9 is driven beginning at this point. The start switch is turned on at t2 and the high-pressure fuel pump 10 is driven simultaneously with cranking. The fuel pressure Pf at this time is low, the fuel injection timing is advanced, and fuel is injected in the first half of the compression stroke. The fuel injection amount is set to a large value because of wall flow correction.

Combustion is completed at t3, and the fuel pressure Pf increases with increased engine speed. The fuel injection timing is delayed as the fuel pressure Pf increases. At this time, the fuel injection amount is gradually reduced by the decrease in the wall flow correction.

When the fuel pressure Pf exceeds the threshold value SL at t4, compression stroke injection is carried out with delayed optimum injection timing.

In accordance with the present embodiment, fuel is injected in the compression stroke when the catalyst requires warming, the fuel injection timing in the compression stroke is set in accordance with the fuel pressure, the fuel injection timing is set in the first half of the compression stroke when the fuel pressure is low, compression stroke injection is made possible from the time that the fuel pressure is low by configuring the fuel injection timing to be delayed as the fuel pressure increases, the fuel injection timing can be brought closer to optimum injection timing as the fuel pressure increases, and the occurrence of wall flow is therefore kept to the very minimum to ensure that the amount of HC exhaust is reduced.

In accordance with the present embodiment, since the fuel injection timing of the delay limit in which fuel can be injected is set in accordance with the fuel pressure, and fuel is injected with the fuel injection timing of the delay limit, transition to optimum injection timing can be made as early possible and the desired combustion can be carried out at an early stage.

In accordance with the present embodiment, the fuel injection amount is corrected in accordance with the fuel injection timing, and the fuel injection timing is adjusted upward as the fuel injection timing is advanced, so accurate wall flow correction is made possible. In other words, when determining the fuel injection amount with consideration given to the portion taken by wall flow in order to generate torque that overcomes friction, the fuel injection amount can be reduced and combustion improved to the extent that the wall flow is reduced by compression stroke injection (key symbol A in FIG. 7).

In accordance with the present embodiment, when the fuel pressure has exceeded a predetermined value in which fuel can be injected with optimum injection timing in the compression stroke, the setting of the fuel injection timing that conforms to the fuel pressure is stopped, and the combustion stability can be improved by injecting fuel with optimum injection timing. In this case, since the combustion stability is improved, the spark timing can be proportionally delayed, and an increase in the exhaust temperature can be ensured in order to promote warming of the catalyst.

As used herein to describe the invention, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The term "detect" as used herein to describe an operation or function carried out by a component, a section, a device or the like includes a component, a section, a device or the like that does not require physical detection, but rather includes determining or computing or the like to carry out the operation or function. The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A direct fuel injection/spark ignition engine control device comprising:

a fuel pressure detection section configured to detect fuel pressure supplied by a fuel pump to a fuel injection valve; and a fuel injection control section configured to set fuel injection timing to inject fuel in a compression stroke in accordance with the fuel pressure and in accordance with a catalyst warming condition, the fuel injection control section being further configured to set fuel injection timing to inject fuel in the compression stroke when the fuel pressure is low, and delay the fuel injection timing as the fuel pressure increases.

2. The direct fuel injection/spark ignition engine control device according to claim 1, wherein the fuel injection control section being further configured to set a delay limit for the fuel injection timing in which fuel can be injected in accordance with the fuel pressure.

3. The direct fuel injection/spark ignition engine control device according to claim 1, wherein the fuel injection control section being further configured to adjust a fuel injection amount based on the fuel injection timing, and the fuel injection amount is increased as the fuel injection timing is advanced.

4. The direct fuel injection/spark ignition engine control device according to claim 3, wherein the fuel injection control section being further configured to set an injection end timing in which fuel can be injected based on the fuel pressure with the fuel injection amount being adjusted based on the injection end timing, and to set an injection start timing based on the injection end timing and adjustment to the fuel injection amount.

5. The direct fuel injection/spark ignition engine control device according to claim 1, wherein the fuel injection control section being further configured to set the fuel injection timing in correspondence with the fuel pressure being stopped and inject fuel with an optimal injection timing in the compression stroke when the fuel pressure has exceeded a predetermined value.

6. The direct fuel injection/spark ignition engine control device according to claim 1, wherein the fuel injection control section is further configured to set fuel injection timing to inject fuel in a first half of the compression stroke when the fuel pressure is low.

7. The direct fuel injection/spark ignition engine control device according to claim 2, wherein the fuel injection control section being further configured to adjust a fuel injection amount based on the fuel injection timing, and the fuel injection amount is increased as the fuel injection timing is advanced.

8. The direct fuel injection/spark ignition engine control device according to claim 7, wherein the fuel injection control section being further configured to set an injection end timing in which fuel can be injected based on the fuel pressure with the fuel injection amount being adjusted based on the injection end timing, and to set an injection start timing based on the injection end timing and adjustment to the fuel injection amount.

9. The direct fuel injection/spark ignition engine control device according to claim 8, wherein the fuel injection control section being further configured to set the fuel injection timing in correspondence with the fuel pressure being stopped and inject fuel with an optimal injection timing in the compression stroke when the fuel pressure has exceeded a predetermined value.

10. The direct fuel injection/spark ignition engine control device according to claim 2, wherein the fuel injection control section being further configured to set the fuel injection timing in correspondence with the fuel pressure being stopped and inject fuel with an optimal injection timing in the compression stroke when the fuel pressure has exceeded a predetermined value.

11. The direct fuel injection/spark ignition engine control device according to claim 3, wherein the fuel injection control section being further configured to set the fuel injection timing in correspondence with the fuel pressure being stopped and inject fuel with an optimal injection timing in the compression stroke when the fuel pressure has exceeded a predetermined value.

12. The direct fuel injection/spark ignition engine control device according to claim 4, wherein the fuel injection control section being further configured to set the fuel injection timing in correspondence with the fuel pressure being stopped and inject fuel with an optimal injection timing in the compression stroke when the fuel pressure has exceeded a predetermined value.

13. The direct fuel injection/spark ignition engine control device according to claim 9, wherein the fuel injection control section is further configured to set fuel injection timing to inject fuel in a first half of the compression stroke when the fuel pressure is low.

14. A direct fuel injection/spark ignition engine control device comprising:

fuel pressure detection means for detecting fuel pressure supplied by a fuel pump to a fuel injection valve; and fuel injection control means for setting fuel injection timing to inject fuel in a compression stroke in accordance with the fuel pressure and in accordance with a catalyst warming condition, the fuel injection control means being further configured to set fuel injection timing to inject fuel in the compression stroke when the fuel pressure is low, and delay the fuel injection timing as the fuel pressure increases.

15. A method of controlling direct fuel injection/spark ignition engine comprising:

detecting fuel pressure supplied by a fuel pump to a fuel injection valve;

setting fuel injection timing to inject fuel in a compression stroke in accordance with the fuel pressure and in accordance with a catalyst warming condition, and injecting fuel in the compression stroke when the fuel pressure is low, and delaying the fuel injection timing as the fuel pressure increases.

16. The method according to claim 15, further comprising setting a delay limit for the fuel injection timing in which fuel can be injected in accordance with the fuel pressure.

17. The method according to claim 15, further comprising adjusting a fuel injection amount based on the fuel injection timing, and the fuel injection amount is increased as the fuel injection timing is advanced.

18. The method according to claim 17, further comprising setting an injection end timing in which fuel can be injected based on the fuel pressure with the fuel injection amount being adjusted based on the injection end timing, and setting an injection start timing based on the injection end timing and adjustment to the fuel injection amount.

19. The method according to claim 15, further comprising setting the fuel injection timing in correspondence with the fuel pressure being stopped and inject fuel with an optimal injection timing in the compression stroke when the fuel pressure has exceeded a predetermined value.

20. The method according to claim 15, wherein the injecting fuel occurs in a first half of the compression stroke when the fuel pressure is low.

* * * * *